US005703313A

United States Patent [19]

Pierce et al.

[11] Patent Number: 5,703,313

[45] Date of Patent: Dec. 30, 1997

[54] PASSIVE NONLINEAR FILTER FOR DIGITAL MUSICAL SOUND SYNTHESIZER AND METHOD

[75] Inventors: John R. Pierce, Palo Alto; Scott A. Van Duyne, Stanford, both of Calif.

[73] Assignee: The Board of Trustees of the Leland Stanford Junior University, Palo Alto, Calif.

[21] Appl. No.: 241,327

[22] Filed: May 10, 1994

[51] Int. Cl.[6] ..... G10H 1/02; G10H 1/12

[52] U.S. Cl. ..... 84/622; 84/626; 84/659; 84/662; 84/DIG. 9

[58] Field of Search ..... 84/622–625, 626, 84/659–662, DIG. 9; 364/724.01, 724.17, 724.19; 327/105, 106; 333/156, 157

[56] References Cited

U.S. PATENT DOCUMENTS

| | | | |
|---|---|---|---|
| 3,819,861 | 6/1974 | Mathews . | |
| 3,838,202 | 9/1974 | Nakada | 84/1.24 |
| 4,079,653 | 3/1978 | Finch | 84/1.22 |
| 4,736,663 | 4/1988 | Wawrzynek et al. | 84/1.26 |
| 4,899,115 | 2/1990 | Christian | 330/302 |
| 5,008,634 | 4/1991 | Christian | 330/306 |
| 5,180,877 | 1/1993 | Kunimoto | 84/624 |
| 5,212,334 | 5/1993 | Smith, III | 84/622 |
| 5,448,010 | 9/1995 | Smith, III | 84/622 |
| 5,471,007 | 11/1995 | Van Duyne et al. | 84/622 |
| 5,512,705 | 4/1996 | Kobayashi | 84/622 |

*Primary Examiner*—William M. Shoop, Jr.
*Assistant Examiner*—Marlon T. Fletcher
*Attorney, Agent, or Firm*—Gary S. Williams; Flehr Hohbach Test Albritton & Herbert LLP

[57] ABSTRACT

A music synthesizer includes main resonator, such as a digital waveguide network, that is coupled to a digital passive nonlinear filter. The passive nonlinear filter receives traveling wave signals from the resonator and generates modified traveling wave signals having a different frequency spectrum than the received traveling wave signals without changing the received traveling wave signals' energy content. The passive nonlinear filter then transmits the modified traveling wave signals back into the resonator. The passive nonlinear filter includes a first memory element for retaining an internal energy state and a dual-mode signal generator that generates the modified traveling wave signal from the received signals and the internal energy state using a first signal processing method when the internal energy state has a negative value and using a second distinct signal processing method when the internal energy state has a positive value. The dual-mode signal generator preferably includes a two-level amplifier that multiplies the internal energy state by a first coefficient when the internal energy state has a negative value and by a second distinct coefficient when the internal energy state has a positive value so as to generate an adjustment signal. A first signal combiner combines the received signals with the adjustment signal so as to generate a next value of the internal energy state, and a second signal combiner combines the adjustment signal and the retained internal energy state to generate the modified traveling wave signal that is transmitted into the resonator.

5 Claims, 9 Drawing Sheets

PASSIVE NONLINEAR FILTER FOR DIGITAL MUSICAL SOUND SYNTHESIZER AND METHOD

The present invention relates generally to musical sound synthesizers using digital circuitry or computers, and particularly to an energy-conserving, passive nonlinear filter and filtering technique for shifting or spreading spectral energy so as to generate a certain class of sound effects associated with gongs, cymbals and other acoustic percussion instruments.

BACKGROUND OF THE INVENTION

It is well known that nonlinearities, small or large, favorably affect the sounds of many musical instruments. In Chinese gongs or tamtams and in cymbals, nonlinearities cause the transfer of energy from lower frequency modes of vibration to higher frequency modes of vibration after the instrument has been struck. In this process, the nonlinearities transfer energy from vibrations of one frequency to vibrations of another frequency. Their role is "passive" in that they do not generate energy, they only transfer it.

While nonlinearities such as square law nonlinearities can be incorporated in the computer generation of sounds, conventional computer processes for incorporating nonlinearities in synthesized sounds result in the generation of high frequency energy. In endeavoring to add high frequency energy, the process of sound generation becomes unstable, and useless signals of high amplitude are generated, which then must be suppressed by various filtering and numerical signal processes.

The present invention is based on these observations, and the discovery of some digital signal processing techniques which passively spread energy in a manner that mimics the frequency spreading in cymbals and Chinese gongs.

SUMMARY OF THE INVENTION

The present invention is a music synthesizer having a main resonator waveguide network (e.g., a loop or mesh) that is coupled to a digital passive nonlinear filter. The passive nonlinear filter receives traveling wave signals propagating in the resonant network and passively modifies those received signals so as to generate modified traveling wave signals having a different frequency spectrum than the received traveling wave signals without changing the received traveling wave signals' energy content. The passive nonlinear filter then transmits the modified traveling wave signals back into the resonator.

The passive nonlinear filter includes a first memory element for retaining an internal energy state and a dual-mode signal generator that generates the modified traveling wave signal from the received signals and the internal energy state using a first signal processing method when the internal energy state has a negative value and using a second distinct signal processing method when the internal energy state has a positive value.

In the preferred embodiment the passive nonlinear filter's dual-mode signal generator has a two-level attenuator/amplifier that multiplies the internal energy state by a first coefficient when the internal energy state has a negative value and by a second distinct coefficient when the internal energy state has a positive value so as to generate an adjustment signal. A first signal combiner in the passive nonlinear filter combines the received signals with the adjustment signal so as to generate a next value of the internal energy state, and a second signal combiner that combines the adjustment signal and the retained internal energy state to generate the modified traveling wave signal that is transmitted into the resonator.

BRIEF DESCRIPTION OF THE DRAWINGS

Additional objects and features of the invention will be more readily apparent from the following detailed description and appended claims when taken in conjunction with the drawings, in which:

DESCRIPTION OF THE PREFERRED EMBODIMENT

Figure 1:
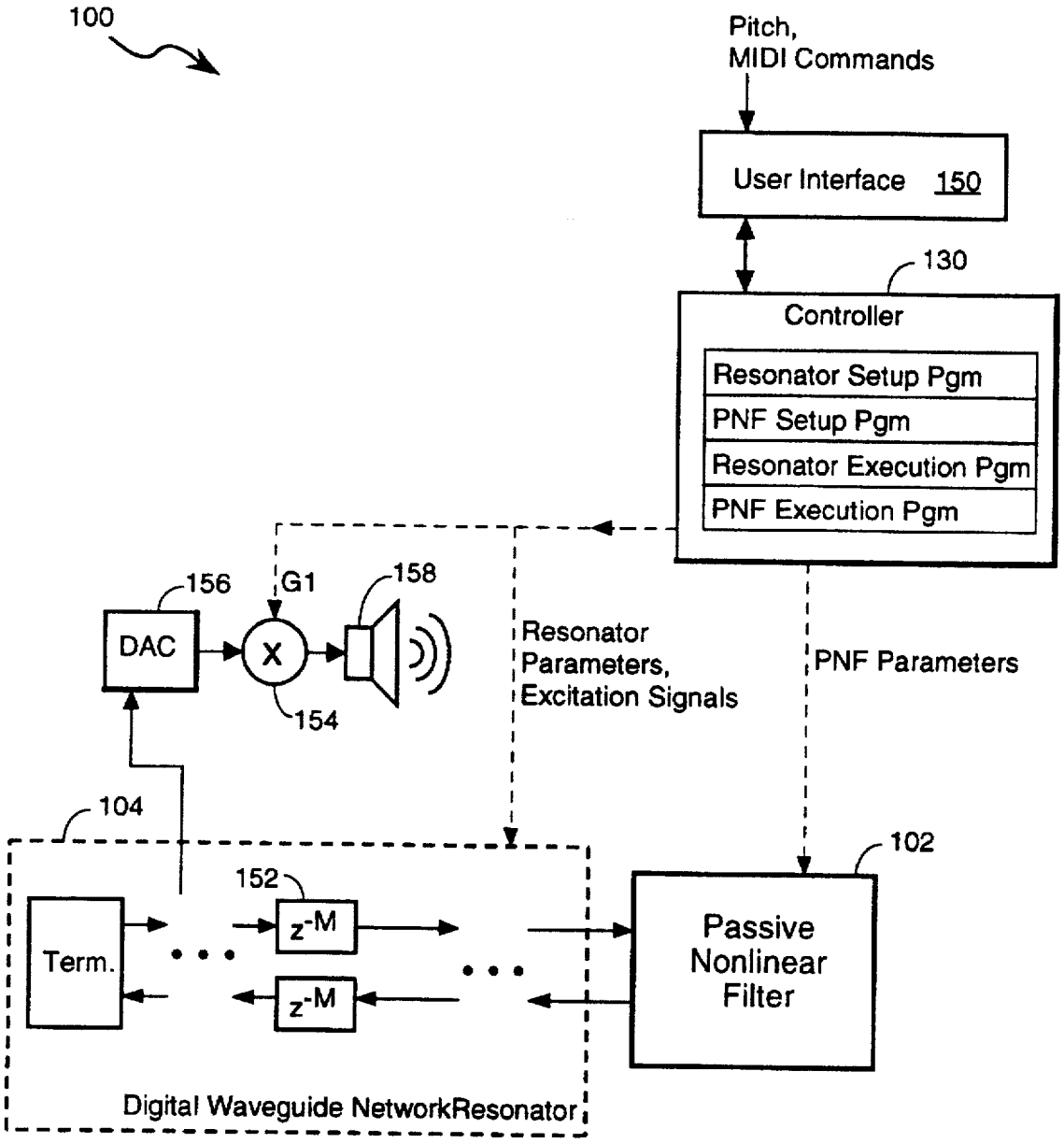
FIG. 1 is a block diagram of a musical sound synthesizer system incorporating the passive nonlinear filter of the present invention.

Referring to FIG. 1, there is shown a music synthesizer 100 in which a passive nonlinear filter (PNF) 102 is coupled to a digital waveguide resonator 104. The PNF 102 and the resonator 104 together simulate the acoustic sound generation of a cymbal or Chinese gong, or any other musical instrument with nonlinear energy exchange between or among frequency modes. The operation of music synthesizer 100 is controlled by a controller 130, typically a microprocessor such as those found in Yamaha synthesizers or the microprocessors found in desktop computers. The controller 130 receives commands from a user interface 150 that typically includes command input devices such as a set of function buttons, vibrato and other control wheels, a keyboard for specifying tones or notes to be generated, as well as output devices such as an LCD display and other visual feedback output devises that confirm user commands and inform the user of the state of the synthesizer. In most implementations, the user interface 150 can be coupled to a computer so as to receive MIDI commands, pitch values and the like from a computer.

The controller 130 includes a resonator setup program that generates control parameters for the main resonator, such as delay line lengths for the resonator's delay lines 152, scattering junction and termination junction parameters that determine the resonating properties of the resonator 104, and the gain constant G1 of the resonator's output amplifier 154. Similarly, a PNF setup program sets the PNF's control parameters, which are the two spring constants associated with the PNF 102. Music synthesis by the system 100 is performed under the control of resonator and PNF execution programs executed by the controller 130. The signals output by the resonator are converted from digital form to an analog voltage by a digital to analog converter 156, are amplified by the output amplifier 154 and then transmitted to one or more speakers 158 so as to generate audible sounds.

In the preferred embodiment, all signals or waveforms in the synthesizer are updated at a rate of 44,100 samples per second. For simplicity, in the equations in this document, time is represented by a variable n which starts at a value of zero at is incremented by one each sample period. Thus, after one second n will have a value of 44,100. Since the sampling rate of the preferred embodiment is 44,100 samples per second, the output signal generated by the synthesizer can have frequency components up to approximately 22 kHz.

Figure 2:
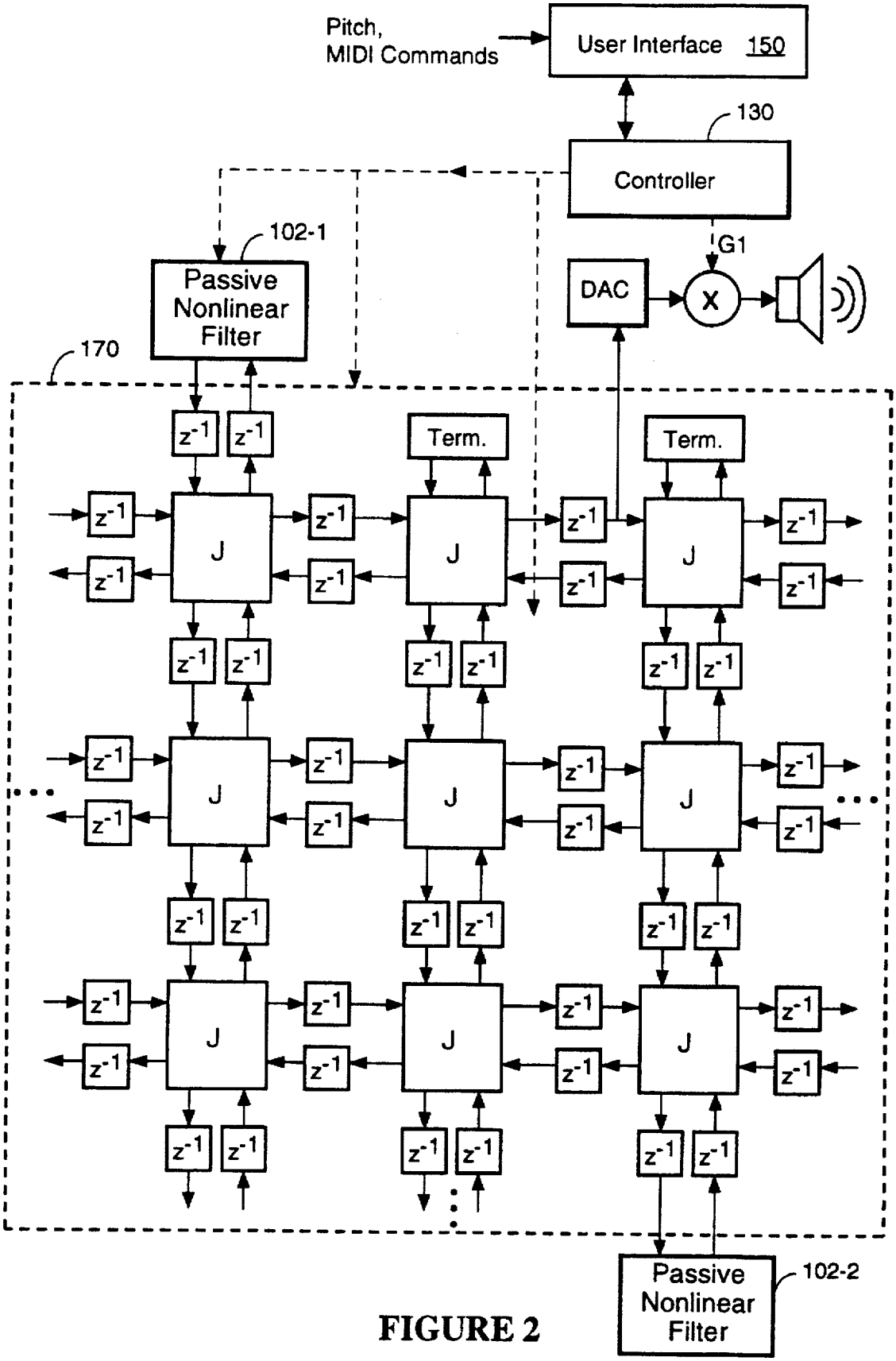
FIG. 2 is a block diagram of a musical sound synthesizer system incorporating two passive nonlinear filters of the present invention coupled to a resonator formed from a two-dimensional mesh of digital waveguides.

The resonator 104 can be any arbitrary resonant digital system, and thus can be a one-dimensional oscillator loop, a two-dimensional mesh of digital waveguides, or any other resonator subsystem. As shown in FIG. 2, a plurality of passive nonlinear filters 102-1, 102-2 can be coupled to a resonator 104. For instance, each PNF 102 can be assigned different coefficients so as to affect signals in different regions of the frequency spectrum.

The PNF 102 is essentially a first-order allpass filter with a time-varying coefficient. In practice, the PNF 102 is intended to be attached at the termination of a waveguide, or inserted at any other point in a resonant system where traveling wave propagation is being computed. Its purpose is to introduce a controllable energy spreading into the resonant modes of a feedback system without risking system instability or unwanted energy loss. This is otherwise impossible in a wholly linear system.

The PNF 102 is particularly useful, if not essential, for the construction of fine gong and cymbal sounds using a two-dimensional digital waveguide mesh, although its usefulness is not limited to this application.

Theory of Operation

Figure 3A:
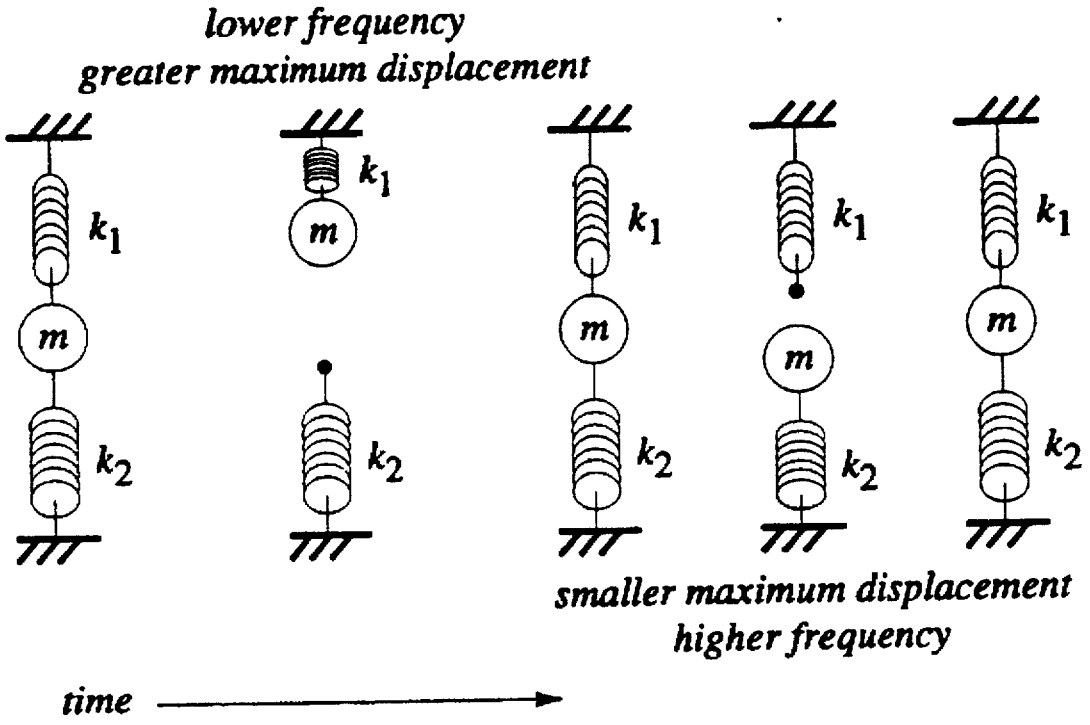
FIG. 3A depicts a passive nonlinear mass/spring oscillator.

Consider a passive nonlinear physical mass/spring oscillator as shown in FIG. 3A. In this system, the springs are taken to be at rest when the mass is at displacement zero, touching both springs, but feeling no force from either spring. When the mass is at a positive displacement, it is feeling force from the upper spring with stiffness constant $k_1$; when it is at negative displacement, it is feeling force from the lower spring with stiffness constant $k_2$.

Note that the resultant oscillation is clearly periodic, but that the upper half of the cycle is at a different frequency and has a different maximum displacement than the lower half of the cycle. When $k_1$ and $k_2$ are nearly equal, but different, this nonlinear oscillator has an essentially sinusoidal response, but with a rolling-off set of harmonic overtones due to the slight discontinuity in the displacement velocity occurring at displacement zero-crossings.

Figure 3B:
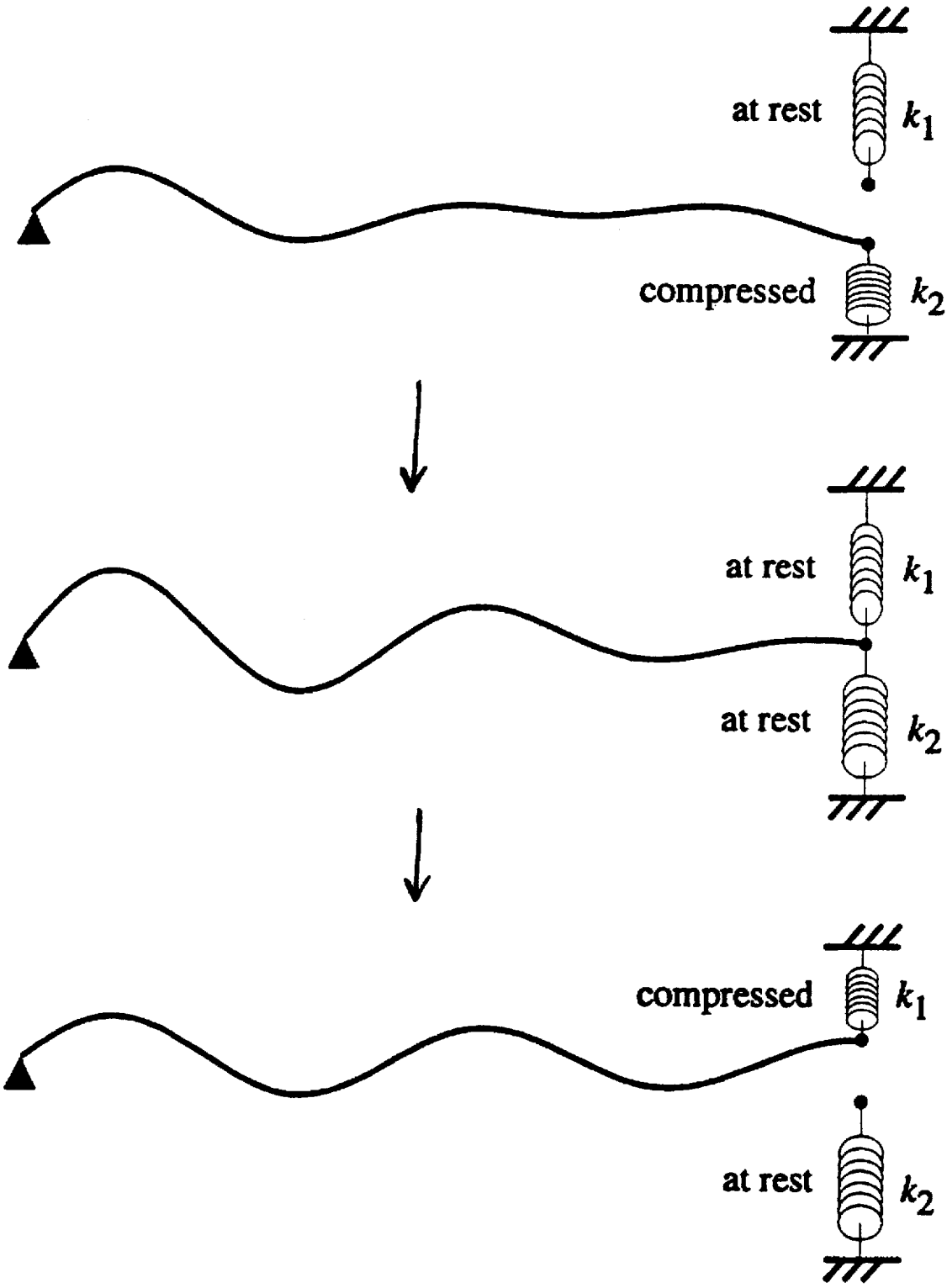
FIG. 3B depicts a passive nonlinear mass/spring oscillator coupled to the end of a string.

By replacing the mass in FIG. 3A by the end of a string having a wave impedance of $R_O$, we arrive at the structure shown in FIG. 3B. Three states of the system are shown in FIG. 3B: first, the lower spring is compressed, while the upper spring is at rest; second, both springs are at rest; and, third, the upper spring is compressed, while the lower spring is at rest. In effect, the spring termination gadget of FIG. 3B is equivalent to a single nonlinear spring whose stiffness constant is $k_1$ when the displacement is positive and $k_2$ when the displacement is negative.

Now consider what is happening to the energy in the system given in FIG. 3B. When the lower spring is compressed, some energy from the string is converted to potential energy stored in the spring. When the lower spring returns to its rest state, the stored spring energy is entirely returned to the string, and the spring contains no stored energy. When the upper spring is then compressed, exactly the same kind of energy exchange occurs.

If the spring stiffness constant had changed while stored potential energy was still in the spring, the stored energy would be scaled by the new relative stiffness of the spring. In this case, the stored energy before the stiffness change would be different than the stored energy after the stiffness change, leading to the creation or loss of energy, possibly resulting in a non-passive system.

Figure 4:
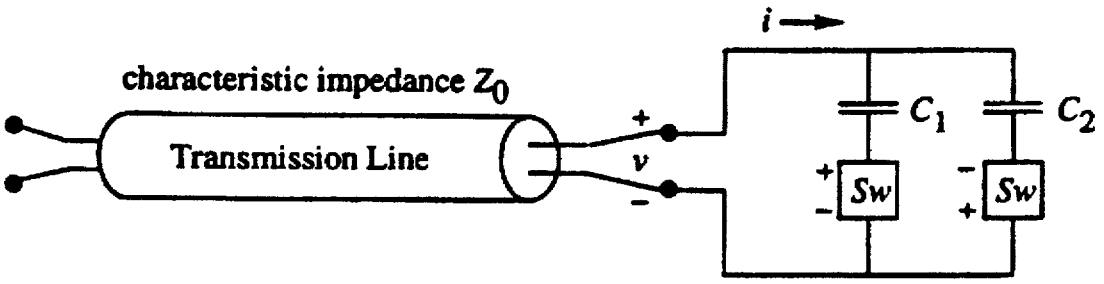
FIG. 4 is a block diagram of an electrical circuit which is the electrical analog of the system shown in FIG. 3.

The passive nonlinear filter was originally conceived in the electrical domain, as shown in FIG. 4. The nonlinear spring termination of a string is mathematically equivalent to a transmission line terminated by two capacitors connected in parallel, with each capacitor connected in series with ideal switches allowing current to pass depending on the sign of the voltage across them. Here, the electrical characteristic impedance, $Z_O$, replaces the mechanical wave impedance of the string, $R_O$; voltage, v, replaces mechanical force, f; and current, i, replaces mechanical displacement velocity, v.

Figure 5:
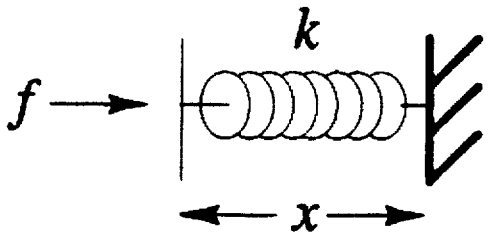
FIG. 5 depicts a simple linear spring system.

The force equation for the ideal linear spring shown in FIG. 5 is, $$f(t)=k\,x(t)\rightarrow df(t)/dt=kv(t) \tag{1}$$

where f(t) is the force applied on the spring, x(t) is the compression distance of the spring, v(t) is the velocity of compression, and k is the spring stiffness constant. x(t) is taken to be zero at rest, negative for compression and positive for stretching.

Taking the Laplace transform, and assuming no initial force on the spring, i.e., f(0)=0, we get, $$F(s)=(k/s)\,V(s) \tag{2}$$

Here, k/s is the lumped impedance of the spring. Setting $s=j\omega$ gives the frequency response of this system.

The traveling wave solution to the ideal lossless vibrating string equation is based on the fact that velocity and force at any point on the string may be decomposed into left- and right-going traveling waves, $$V(s)=V_r(s)+V_l(s) \tag{3}$$

$$F(s)=F_r(s)+F_l(s) \tag{4}$$

where $V_r$ and $F_r$ represent right-going waves on the string, and $V_l$ and $F_l$ represent left-going waves on the string. In addition, there is an impedance relation between force and velocity waves traveling in the same direction, $$F_r(s) = R_0\, V_r(s) \qquad F_l(s) = -R_0 V_l(s) \tag{5}$$

where $R_0$ is a positive real number representing the wave impedance of the ideal lossless string which is dependent on both the tension and mass density of the string.

Figure 6:
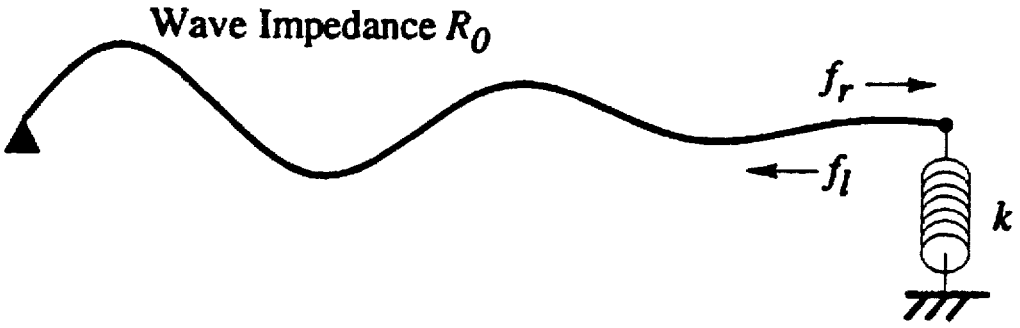
FIG. 6 depicts a string terminated by a simple spring.

A string terminated with a spring is shown in FIG. 6. We may now make the change of variables from F and V to $F_l$ and $F_r$ in the spring termination system equation using Equations (3), (4), and (5) to compute a force wave transfer function from $F_r$ to $F_l$.

$$F(s)=(k/s)\, V(s) \tag{6}$$

$$F_r(s)+F_l(s)=(k/s)\{F_r(s)-F_l(s)\}/R_0 \tag{7}$$

$$F_l(s)=(\{k/s-R_0\}/\{k/s+R_0\})F_r(s) \tag{8}$$

This gives us a transfer function from the right-going force wave (into the spring) to the left-going force wave (out of the spring). The transfer function is stable allpass since its pole is at $s=-k/R_0$ and its zero is $s=k/R_0$, where k and $R_0$ are defined to be positive real numbers.

Next, we apply the bilinear transform, $$s\leftarrow\alpha(1-z^{-1})/(1+z^{-1}) \tag{9}$$

to map from continuous time to discrete time without aliasing to obtain, $$F_l(z)=H(z)F_r(z) \tag{10}$$

where, $$H(z)=(a_0+z^{-1})/(1+a_0z^{-1}),\ \text{with}\ a_0=(k-\alpha R_0)/(k+\alpha R_0) \tag{11}$$

$a_0$ ranges from −1 to 1 as k ranges from 0 to ∞. α is a degree of freedom in the bilinear transform allowing some control over the nature of the frequency warping in moving from continuous time to discrete time.

By a similar derivation, we may obtain the equivalent velocity wave transfer function, $$V_l(z)=-H(z)V_r(z) \tag{12}$$

Figure 7:
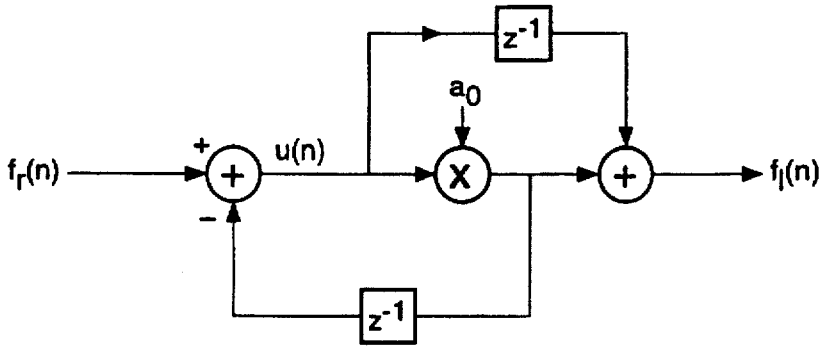
FIG. 7 is a block diagram of a one-pole allpass spring termination suitable for use in a digital signal processor.

FIG. 7 shows a system diagram of the spring termination, H(z), using the force wave construction given in Equations 10 and 11. The time domain operation of the allpass filter of FIG. 7 is computed during each time period n, as follows:

$$u(n)=f_r(n)-a_0u(n-1)$$

$$f_l(n)=a_0u(n)+u(n-1)$$

Since the filter coefficient, $a_0$, represents the relative spring stiffness, we need only change $a_0$ to effect a change in the stiffness of the spring termination. We must, however, effect the change at the right time to preserve digital passivity.

Referring to FIG. 7, consider the case where the input signal to the filter is always zero, $f_r(n)=0$, but where there is some internal state value, namely, let $u(-1)=u_0$. Since, we see from the system diagram, $$u(n) = -a_0u(n-1) \tag{13}$$
$$= (-a_0)^{n+1}u_0 \tag{14}$$

the filter output signal, which is attributable solely to the internal filter energy state ringing out, can be represented as follows:

$$f_l(n) = -a_0u(n-1) \tag{15}$$
$$= a_0[-a_0\, u(n-1)] + u(n-1) \tag{16}$$
$$= (1-a_0^2)u(n-1) \tag{17}$$
$$= (1-a_0^2)(-a_0)^n u_0 \tag{18}$$

If we change the filter coefficient, $a_0$, it is clear that the internal state energy will ring out of the filter with a different decay rate than if the coefficient had not been changed. Such coefficient changes, if made arbitrarily, may lead to instability in a feedback loop. However, if $u_0$ is zero or near zero, we can change the coefficient with relative impunity, since the resultant discontinuity in the state energy will be minimal or zero. Therefore, in accordance with the present invention, we choose to gate the filter coefficient change on the sign of u(n), to maintain passivity in the nonlinear allpass filter.

Figure 8:
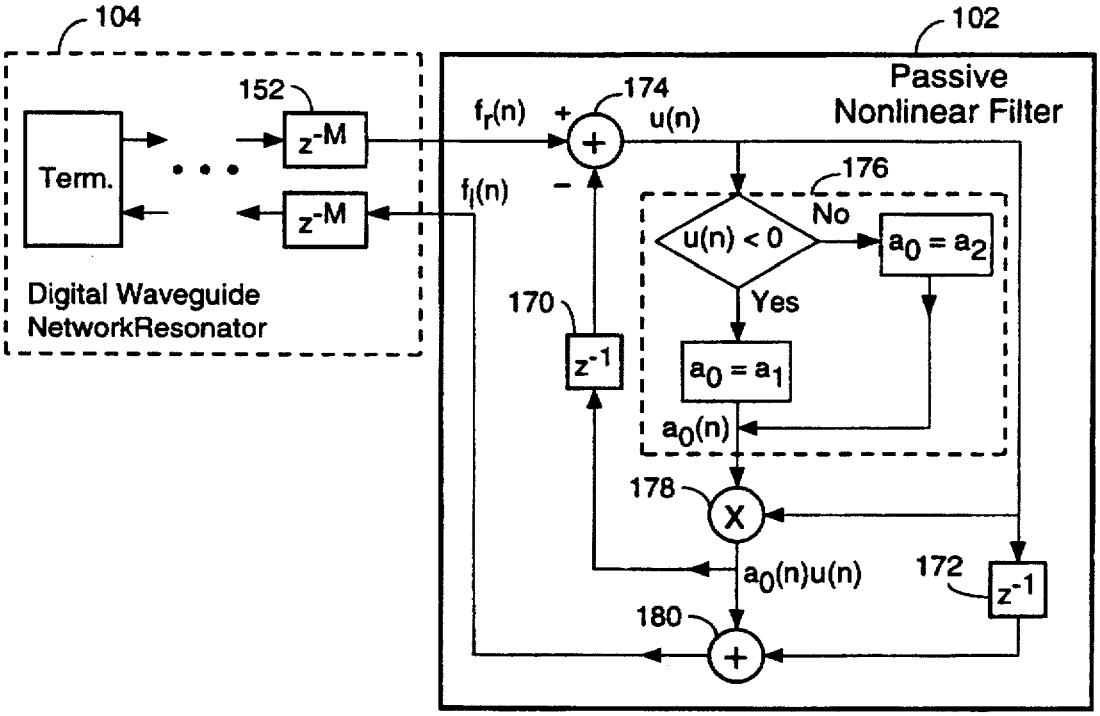
FIG. 8 is a block diagram of the preferred embodiment of a one-pole allpass passive nonlinear filter, suitable for execution by a computer or digital signal processor, coupled to a digital waveguide resonator.

FIG. 8 depicts a preferred embodiment of a passive nonlinear filter 102 coupled to a digital waveguide resonator 104. The PNF 102 receives a signal $f_r(n)$ from the resonator 104. The PNF includes two memory elements in the form of unit delay elements 170, 172. Delay element 170 stores the value $a_0(n)u(n)$ for one time period, and outputs the value $a_0(n-1)u(n-1)$. Note that the filter coefficient $a_0$ is now time varying and thus has an associated time index. Delay element 172 stores the internal energy state value u(n) for one time period, and outputs the value u(n−1).

Adder 174 generates the internal energy state value u(n) by subtracting the output of delay element 170 from the received signal, $f_r(n)$, as follows: $u(n)=f_r(n)-a_0(n-1)u(n-1)$.

Decision logic 176 determines the sign of the internal energy state u(n) and sets $a_0(n)$ equal to $a_1$ when u(n) is less than zero, and otherwise (i.e., when u(n) is greater than or equal to zero) sets $a_0(n)$ equal to $a_2$. Multiplier 178 then multiplies the current value of the internal energy state u(n) by the current value of $a_0(n)$ to generate $a_0(n)u(n)$. Finally, adder 180 generates output signal $f_l(n)$ by adding the output u(n−1) of delay element 172 with the value generated by multiplier 178: $f_l(n)=u(n-1)+a_0(n)u(n)$.

From the allpass filter implementation in FIG. 7, we may observe that, $$f_l(n)=a_0u(n)+u(n-1) \tag{19}$$

Also we have, $$u(n)=f_r(n)-a_0u(n-1)\rightarrow f_r(n)=u(n)+a_0\, u(n-1) \tag{20}$$

Since, the actual physical force applied to the spring termination is equal to the sum of the input and output force waves, as defined in Equation (4), we may derive an expression of the actual force on the spring, f(n), from (19) and (20), $$f(n) \equiv f_r(n) + f_l(n) \tag{21}$$
$$= [u(n) + a_0u(n-1)] + [a_0u(n) + u(n-1)] \tag{22}$$
$$= (1+a_0)[u(n) + u(n+1)] \tag{23}$$

Equation (23) indicates that the actual physical force on the spring is proportional to a linearly interpolated value of signal u at time n−0.5. From Equation (1), displacement of the spring termination is zero when force is zero, and f(n) is zero when u(n)+u(n−1) is zero. Therefore, when u changes sign between times n−1 and n, the spring displacement is closest to zero. This is the physically correct time to let the spring stiffness coefficient change for the nonlinear spring termination system given in FIG. 3B.

Why the PNF Works from a Phase Modulation Perspective

We have observed that the PNF is essentially a one-pole allpass filter with a time-varying coefficient. We may study the effects of the PNF in a feedback loop by studying the effects of coefficient-variation on a one-pole allpass filter. We, first, consider how the phase response of such a filter depends on its coefficient, then, how sinusoidal variation of that coefficient generates sidebands in the output signal. From there, we will see how the sort of time-variation defined in the PNF structure will generate a desirable energy spreading in a feedback loop.

Figure 9:
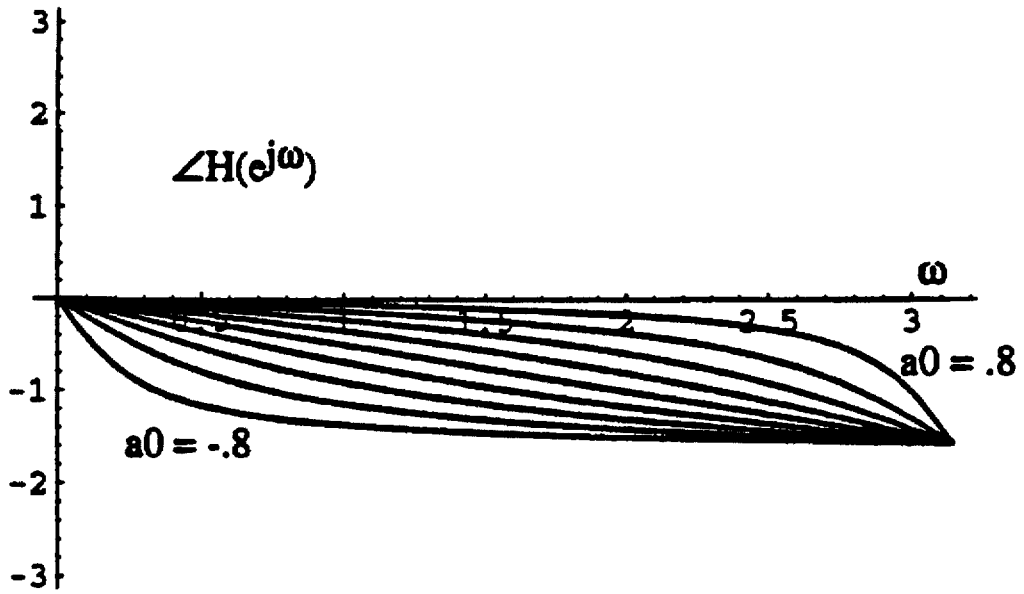
FIG. 9 is a graph depicting the phase response of the one-pole allpass filter of FIG. 7.

Consider the force wave transfer function given in Equation (11). This is a one-pole allpass filter. Its gain is unity and, in general, its phase response, $\angle H(e^{j\omega})$, decreases monotonically from 0 to $-\pi/2$ as $\omega$ goes from 0 (DC) to $\pi$ (Nyquist frequency). FIG. 9 shows several overlaid phase response plots for this filter with different coefficient values, $a_0$ ranging from −0.8 to 0.8.

Now, consider two allpass filters, $H_1(z)$ and $H_2(z)$ which have two different coefficients, $a_1$ and $a_2$, respectively. Let $$a_1=a_{center}+\Delta a/2$$

and $$a_2=a_{center}-\Delta a/2,$$

where $a_{center}$ is the center of variation ($a_{center}=(a_1+a_2)/2$), and $\Delta a$ is the maximum deviation ($\Delta a=a_2-a_1$).

Figure 10:
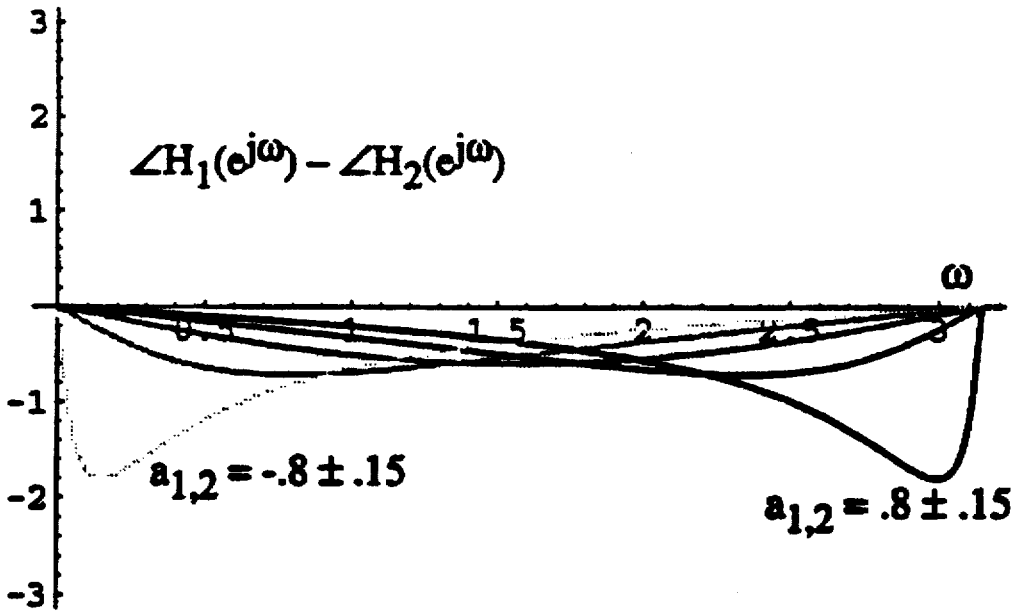
FIG. 10 is a graph depicting the difference in phase responses of two filters of the type shown in FIG. 7 for a first set of "spring" coefficients.

FIG. 10 shows the difference in phase responses of the two filters, $\angle H_1(e^{j\omega})-\angle H_2(e^{j\omega})$, for a series of coefficient pairs generated by letting $a_{center}$ range from −0.8 to 0.8, and holding $\Delta a$ constant at 0.3. What the plot shows is that $a_{center}$ determines which region of the spectrum has the greatest phase response variation for a given $\Delta a$.

Figure 11:
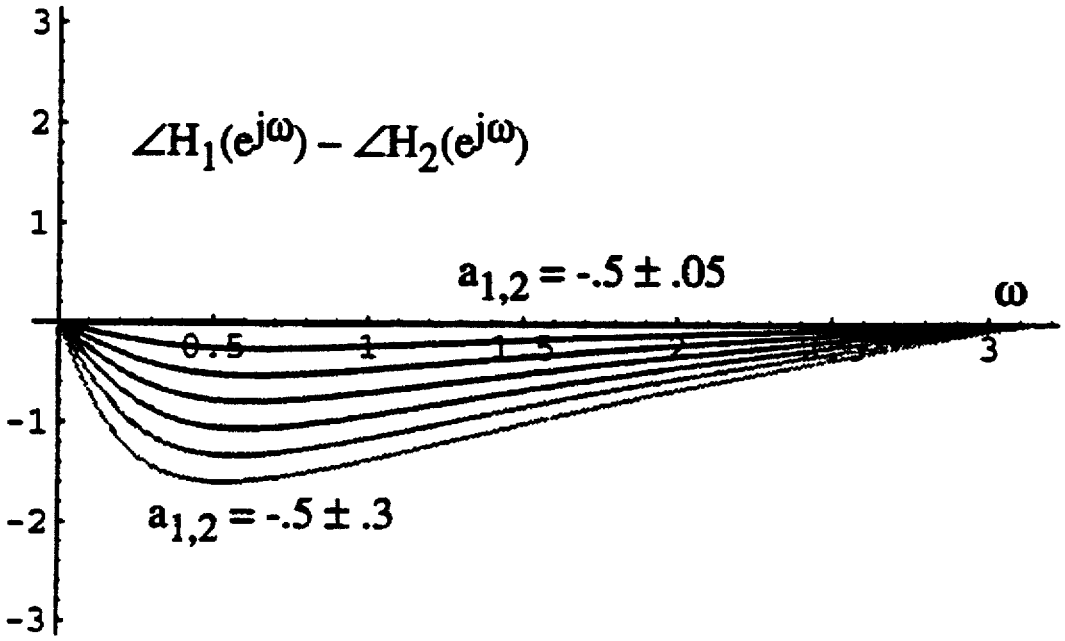
FIG. 11 is a graph depicting the difference in phase responses of two filters of the type shown in FIG. 7 for a second set of "spring" coefficients.

FIG. 11 shows the phase response difference for a series of coefficient pairs generated by holding $a_{center}$ constant at −0.5 and letting $\Delta a$ range from 0.1 to 0.6. This plot shows how $\Delta a$ determines the amount of phase response variation for a given $a_{center}$.

Sinusoidal Variation of the Coefficient

Figure 12:
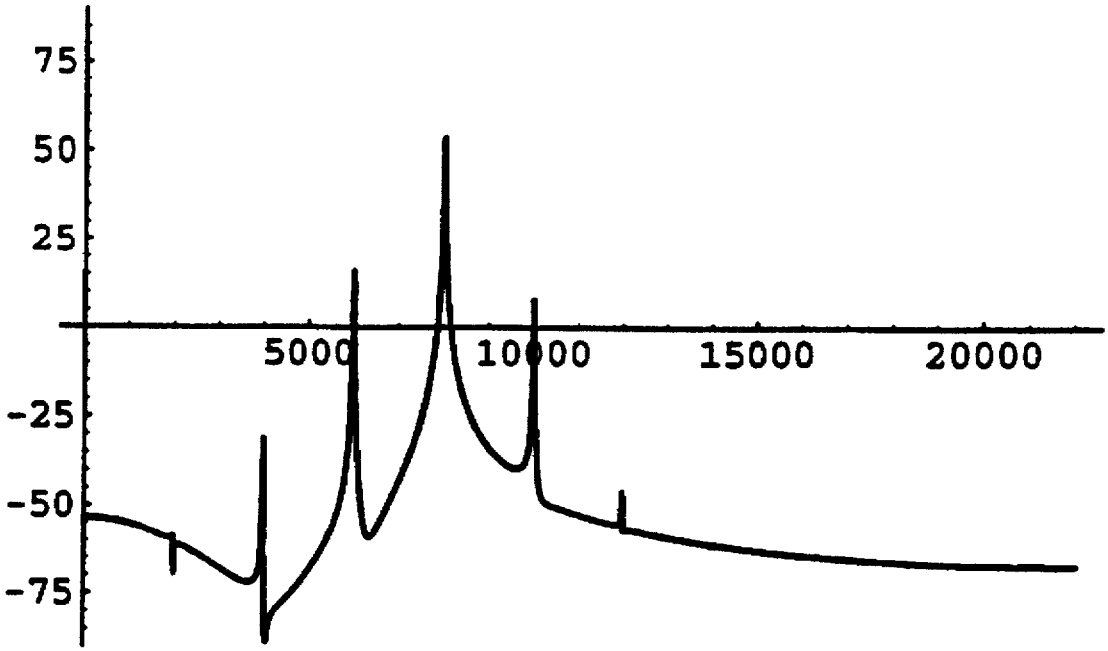
FIG. 12 is a graph depicting the frequency response of the filter of FIG. 7 when driven by a sinusoidal signal and the filter coefficient is modulated by another sinusoidal signal.

If we drive the one-pole allpass filter, H(z), with a sinusold of frequency $f_1$, and vary the coefficient, $a_0$, sinusoidally at frequency $f_2$ around some center value, $a_{center}$, with deviation $\Delta a$, we should expect the filter to apply a quasi-sinusoidal phase modulation to the input signal due to the phase response variation predicted in the preceding paragraphs. The resultant output signal of the filter should contain sidebands around the driving frequency, $f_1$, separated by the coefficient modulating frequency, $f_2$. Furthermore, the deviation, $\Delta a$, should determine the "index" of modulation, in the FM sense, and thus, the amount of energy in the sidebands. FIG. 12 shows the magnitude response on a dB scale of H(z), with sinusoidally varying coefficient, $a_0(n)=-0.7-\cos(2\pi f_2 nT)$, driven by an input sinusoid, $\cos(2\pi f_1 nT)$, where $f_1=8000$ Hz, $f_2=2000$ Hz, and the sampling interval, $T=1/44{,}100$ seconds. FIG. 12 verifies that the filter output is very near to the predicted phase modulation, containing a set of sidebands of the form, $\cos(2\pi f_1 T\pm k\ 2\pi f_2 T)$.

Step Variation of the Coefficient

In general, if we flip the coefficient of a one-pole allpass filter between two values periodically, the coefficient signal, $a_0(n)$, is then a square wave with a spectrum containing rolling-off odd harmonics. The output signal spectrum produced by this kind of coefficient modulation will contain greater emphasis in the odd sidebands than a simple sinusoidally modulated filter, due to the odd harmonics in the coefficient modulation signal.

For coupling to occur in the resonant system, the sidebands produced by the modulated allpass filter must fall on supported modes of the system. When a sideband coincides with a supported mode, that mode will be driven by the energy in the appropriate sideband. Energy from sidebands which do not fall on supported modes will not drive any particular mode and will simply be absorbed back into the system.

In the PNF filter of FIG. 8, we choose to gate the coefficient selection on the state signal u(n). Since the coefficient signal will have the same effective fundamental as the driving input signal, we can expect the resultant sidebands to fall on multiples of the effective fundamental of the input signal, thereby driving at least some supported modes of the system. The PNF sidebands are, therefore, tuned exactly right for energy spreading to occur into nearby system modes.

Figure 13:
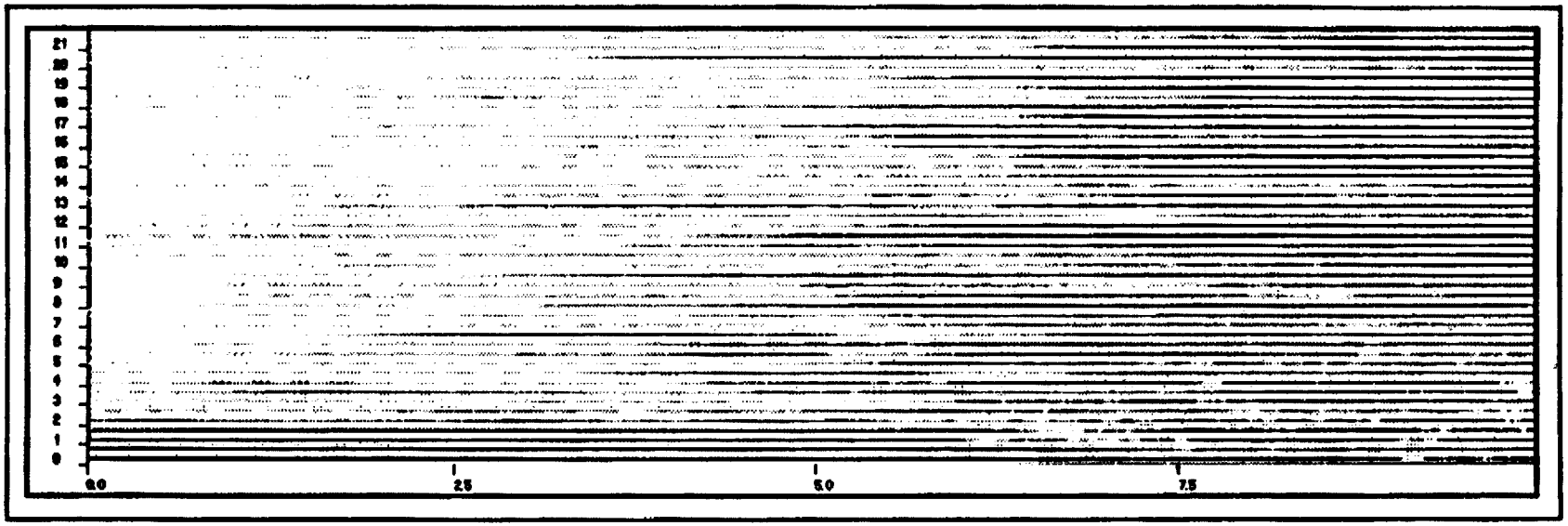
FIG. 13 is a sonogram depicting the evolution of spectral energy over a period of time in a system using the passive nonlinear filter of the present invention.

FIG. 13 shows the gradual spreading out of spectral energy of a waveguide resonator system terminated with a PNF.

While the present invention has been described with reference to a few specific embodiments, the description is illustrative of the invention and is not to be construed as limiting the invention. Various modifications may occur to those skilled in the art without departing from the true spirit and scope of the invention as defined by the appended claims.

What is claimed is:

1. A signal synthesizer, comprising:

a resonant network in which traveling wave signals propagate; and a passive nonlinear filter coupled to said resonant network for receiving said traveling wave signals propagating in said resonant network, for passively modifying said received signals so as to generate modified traveling wave signals having a different frequency spectrum than said received traveling wave signals without changing said received traveling wave signals' energy content, and for transmitting said modified traveling wave signals into said resonant network;

said passive nonlinear filter including a first memory element for retaining an internal energy state and a dual-mode signal generator that generates said modified traveling wave signal from said received signals and said internal energy state using a first signal processing method when said internal energy state has a negative value and using a second distinct signal processing method when said internal energy state has a positive value.

2. The signal synthesizer of claim 1, wherein said passive nonlinear filter's dual-mode signal generator includes a two-level attenuator/amplifier that multiplies said internal energy state by a first coefficient when said internal energy state has a negative value and by a second distinct coefficient when said internal energy state has a positive value to generate an adjustment signal, a first signal combiner that combines said received signals with said adjustment signal so as to generate a next value of said internal energy state, and a second signal combiner that combines said adjustment signal with said retained internal energy state to generate said modified traveling wave signal.

3. The signal synthesizer of claim 1, wherein said resonant network includes a digital waveguide network includes a two-dimensional matrix of waveguide sections interconnected by junctions, each waveguide section including two digital delay lines running parallel to each other for propagating signals in opposite directions; each said junction connected between waveguide sections having associated reflection and propagation coefficients for controlling reflection and propagation of signals in the waveguide sections connected to said junction; wherein a multiplicity of said junctions each interconnect at least four of said waveguide sections so as to scatter and intermix signals in said at least four waveguide sections;

said passive nonlinear filter's dual-mode signal generator includes a two-level attenuator/amplifier that multiplies said internal energy state by a first coefficient when said internal energy state has a negative value and by a second distinct coefficient when said internal energy state has a positive value to generate an adjustment signal, a first signal combiner that combines said received signals with said adjustment signal so as to generate a next value of said internal energy state, and a second signal combiner that combines said adjustment signal and said retained internal energy state to generate said modified traveling wave signal.

4. A method of synthesizing sounds, comprising the steps of:

receiving traveling wave signals from a resonator; and passively modifying said received traveling wave signals so as to generate modified traveling wave signals having a different frequency spectrum than said received traveling wave signals without changing said received traveling wave signals' energy content, and for transmitting said modified traveling wave signals into said resonator;

said passively modifying step including retaining an internal energy state and generating said modified traveling wave signal from said received signals and said internal energy state using a first signal processing method when said internal energy state has a negative value and using a second distinct signal processing method when said internal energy state has a positive value.

5. The method of claim 4, wherein said passively modifying step including multiply said internal energy state by a first coefficient when said internal energy state has a negative value and by a second distinct coefficient when said internal energy state has a positive value to generate an adjustment signal, combining said received signals with said adjustment signal so as to generate a next value of said internal energy state, and combining said adjustment signal with said retained internal energy state to generate said modified traveling wave signal.

* * * * *